US009964902B2

(12) United States Patent
Noutomi et al.

(10) Patent No.: US 9,964,902 B2
(45) Date of Patent: May 8, 2018

(54) FIXING DEVICE AND IMAGE FORMING APPARATUS

(71) Applicant: Konica Minolta, Inc., Chiyoda-ku, Tokyo (JP)

(72) Inventors: Tatsuhiro Noutomi, Hachioji (JP); Hiroyuki Futami, Hachioji (JP); Katsunori Takahashi, Hachioji (JP); Kenichi Hayashi, Hino (JP); Takashi Nara, Kawagoe (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 15/264,698

(22) Filed: Sep. 14, 2016

(65) Prior Publication Data

US 2017/0097596 A1 Apr. 6, 2017

(30) Foreign Application Priority Data

Oct. 1, 2015 (JP) ..... 2015-195614

(51) Int. Cl.
*G03G 15/00* (2006.01)
*G03G 15/20* (2006.01)

(52) U.S. Cl.
CPC ..... *G03G 15/2039* (2013.01); *G03G 15/2007* (2013.01); *G03G 15/2042* (2013.01)

(58) Field of Classification Search
CPC ..... G03G 15/2039; G03G 15/205; G03G 15/5004; G03G 15/80
See application file for complete search history.

(56) References Cited

U.S. PATENT DOCUMENTS 8,682,192 B2 3/2014 Ikebuchi et al.
2005/0061797 A1 3/2005 Kim et al.
(Continued)

FOREIGN PATENT DOCUMENTS

EP 2 363 759 A1 9/2011
JP 04-005679 A 1/1992
(Continued)

OTHER PUBLICATIONS

The Extended European Search Report dated Apr. 13, 2017 by the European Patent Office in corresponding European Patent Application No. 16187745.1-1568. (8 pages).

*Primary Examiner* — Walter L Lindsay, Jr.
*Assistant Examiner* — Jessica L Eley
(74) *Attorney, Agent, or Firm* — Buchanan Ingeroll & Rooney PC

(57) ABSTRACT

A fixing device includes: a fixing member; a pressure member pressed against the fixing member; a plurality of halogen lamp heaters configured to heat the fixing member; a temperature detecting unit configured to detect a temperature of the fixing member; and a control unit configured to perform half-wave control on at least one first halogen lamp heater by calculating an output Duty and performing energization or de-energization for each half-wave of an AC waveform, and perform switch on/off control on a second halogen lamp heater, the second halogen lamp heater being other than the first halogen lamp heater, wherein the first halogen lamp heater and the second halogen lamp heater have reference voltages satisfying the reference voltage of the first halogen lamp heater<the reference voltage of the second halogen lamp heater, the reference voltages being set in accordance with densities of contained halogen gases.

9 Claims, 4 Drawing Sheets

(56) References Cited

U.S. PATENT DOCUMENTS

| | | | | |
|---|---|---|---|---|
| 2010/0238466 | A1* | 9/2010 | Sano | G03G 15/80 358/1.9 |
| 2012/0051774 | A1 | 3/2012 | Ikebuchi et al. | |

FOREIGN PATENT DOCUMENTS

| | | | |
|---|---|---|---|
| JP | 10-149871 | A | 6/1998 |
| JP | 2003-295685 | A | 10/2003 |
| JP | 2012-053148 | A | 3/2012 |
| JP | 2012-063644 | A | 3/2012 |

* cited by examiner

FIXING DEVICE AND IMAGE FORMING APPARATUS

The entire disclosure of Japanese Patent Application No. 2015-195614 filed on Oct. 1, 2015 including description, claims, drawings, and abstract are incorporated herein by reference in its entirety.

BACKGROUND OF THE INVENTION

Field of the Invention

The present invention relates to a fixing device and an image forming apparatus.

Description of the Related Art

A conventional image forming apparatus includes an image forming unit that forms an image by applying toner onto a paper sheet, and a fixing device that fixes the toner to the paper sheet by heating and pressing the paper sheet having the toner applied thereto. The fixing device may be a device that heats and presses a paper sheet with a nip portion between a pair of rollers including a fixing roller having a heater installed therein, or a device that heats and presses a paper sheet via a fixing belt stretched around the fixing roller.

A halogen lamp heater or the like is normally used as a heater in a heating roller. Switch on/off control is normally performed to control a halogen lamp heater. However, to perform energization in a more specific manner, Duty control depending on an on/off time ratio is performed through phase control.

As examples of such Duty control depending on a time ratio, the following control operations have been suggested: a control operation in which a halogen lamp heater is switched on in accordance with the color temperature of the halogen lamp heater, except for the time Duty during which a chemical attack is likely to occur (see JP 2012-53148 A, for example); and a control operation in which a check is made to determine whether a chemical attack has occurred by calculating deviation of the halogen gas density in the tube from the color temperature, and a halogen lamp heater is switched on to cancel the deviation of the halogen gas density (see JP 2012-63644, for example). However, Duty control depending on a time ratio involves minute segmentation of alternating current. As a result, terminal noise or harmonic noise is generated, and the antinoise circuit and components become complicated.

To counter this problem, half-wave control can be performed as another method of controlling a halogen lamp heater. In half-wave control, energization or de-energization is performed for each half-wave of an AC waveform, and the effective voltage to be applied to the halogen lamp heater differs from the rated voltage.

However, if the above mentioned half-wave control is performed on a conventional halogen lamp heater, a chemical attack might occur, since the effective voltage differs from the rated voltage.

In this halogen lamp heater, tungsten gasified from the tungsten filament due to a temperature rise binds to the halogen gas contained in the halogen lamp heater, to generate tungsten halide. The tungsten halide is thermally decomposed by the filament, and the tungsten is deposited on the filament. That is, a halogen cycle occurs. The above mentioned chemical attack is a phenomenon that occurs in a situation where tungsten is not gasified from a low-temperature filament. More specifically, the halogen gas reacts directly with the tungsten of the filament, to form a tungsten halide and gasify. However, due to the low filament temperature, the tungsten halide cannot be thermally decomposed, and the filament becomes gradually thinner, without any tungsten deposited on the filament.

SUMMARY OF THE INVENTION

In view of the above, an object of the present invention is to provide a fixing device that can appropriately prevent chemical attacks when performing half-wave control on halogen lamp heaters, and an image forming apparatus that includes the fixing device.

To achieve the abovementioned object, according to an aspect, a fixing device reflecting one aspect of the present invention comprises:

a fixing member;

a pressure member pressed against the fixing member;

a plurality of halogen lamp heaters configured to heat the fixing member;

a temperature detecting unit configured to detect a temperature of the fixing member; and a control unit configured to perform half-wave control on at least one first halogen lamp heater of the halogen lamp heaters by calculating an output Duty in accordance with the temperature detected by the temperature detecting unit and performing energization or de-energization for each half-wave of an AC waveform in accordance with the output Duty, and perform switch on/off control on a second halogen lamp heater of the halogen lamp heaters, the second halogen lamp heater being other than the first halogen lamp heater, wherein the first halogen lamp heater and the second halogen lamp heater have reference voltages satisfying the reference voltage of the first halogen lamp heater<the reference voltage of the second halogen lamp heater, the reference voltages being set in accordance with densities of contained halogen gases.

According to an invention of Item. 2, in the fixing device of Item. 1, the control unit preferably calculates the output Duty from the temperature of the fixing member detected by the temperature detecting unit and a predetermined target temperature, calculates an effective voltage from the calculated output Duty and a rated voltage of the first halogen lamp heater, when the calculated effective voltage is higher than the reference voltage of the first halogen lamp heater, performs the half-wave control with the calculated output Duty, when the calculated effective voltage is lower than the reference voltage of the first halogen lamp heater, determines whether a temperature change detected by the temperature detecting unit shows a tendency to rise or whether the temperature change shows a tendency to drop, when the temperature change shows a tendency to rise, sets the output duty at 0, and, when the temperature change shows a tendency to drop, performs the half-wave control with the output Duty equivalent to the reference voltage of the first halogen lamp heater.

To achieve the abovementioned object, according to an aspect, a fixing device reflecting one aspect of the present invention comprises:

a fixing member;

a pressure member pressed against the fixing member;

a plurality of halogen lamp heaters configured to heat the fixing member;

a temperature detecting unit configured to detect a temperature of the fixing member; and a control unit configured to perform half-wave control on at least one end-portion halogen lamp heater and at least one central-portion halogen lamp heater of the halogen lamp heaters by calculating an output Duty in accordance with the temperature detected by the temperature detecting unit and performing energization or de-energization for each half-wave of an AC waveform in accordance with the output Duty, the end-portion halogen lamp heater being configured to heat end portions of the fixing member in an axial direction, the central-portion halogen lamp heater being configured to heat a central portion of the fixing member in the axial direction, wherein the end-portion halogen lamp heater and the central-portion halogen lamp heater have reference voltages lower than a rated voltage, the reference voltages satisfying the reference voltage of the end-portion halogen lamp heater<the reference voltage of the central-portion halogen lamp heater, the reference voltages being set in accordance with densities of contained halogen gases.

According to an invention of Item. 4, in the fixing device of Item. 3, the control unit preferably calculates the output Duty from the temperature of the fixing member detected by the temperature detecting unit and a predetermined target temperature, calculates an effective voltage from the calculated output Duty and a rated voltage of one of the end-portion halogen lamp heater and the central-portion halogen lamp heater, when the calculated effective voltage is higher than the reference voltage of one of the end-portion halogen lamp heater and the central-portion halogen lamp heater, performs the half-wave control with the calculated output Duty, when the calculated effective voltage is lower than the reference voltage of one of the end-portion halogen lamp heater and the central-portion halogen lamp heater, determines whether a temperature change detected by the temperature detecting unit shows a tendency to rise or whether the temperature change shows a tendency to drop, when the temperature change shows a tendency to rise, sets the output duty at 0, and, when the temperature change shows a tendency to drop, performs the half-wave control with the output Duty equivalent to the reference voltage of one of the end-portion halogen lamp heater and the central-portion halogen lamp heater.

To achieve the abovementioned object, according to an aspect, a fixing device reflecting one aspect of the present invention comprises:

a fixing member;

a pressure member pressed against the fixing member;

a plurality of halogen lamp heaters configured to heat the fixing member;

a temperature detecting unit configured to detect a temperature of the fixing member; and a control unit configured to perform half-wave control on a third halogen lamp heater and a fourth halogen lamp heater of the halogen lamp heaters by calculating an output Duty in accordance with the temperature detected by the temperature detecting unit and performing energization or de-energization for each half-wave of an AC waveform in accordance with the output Duty, the third halogen lamp heater and the fourth halogen lamp heater having overlapping regions to heat in the fixing member in an axial direction, wherein, when the output Duty to be most frequently output with respect to the third halogen lamp heater is smaller than the output Duty to be most frequently output with respect to the fourth halogen lamp heater, the third halogen lamp heater and the fourth halogen lamp heater have reference voltages lower than a rated voltage, the reference voltages satisfying the reference voltage of the third halogen lamp heater<the reference voltage of the fourth halogen lamp heater, the reference voltages being set in accordance with densities of contained halogen gases.

According to an invention of Item. 6, in the fixing device of Item. 5, the control unit preferably calculates the output Duty from the temperature of the fixing member detected by the temperature detecting unit and a predetermined target temperature, calculates an effective voltage from the calculated output Duty and a rated voltage of one of the third halogen lamp heater and the fourth halogen lamp heater, when the calculated effective voltage is higher than the reference voltage of one of the third halogen lamp heater and the fourth halogen lamp heater, performs the half-wave control with the calculated output Duty, when the calculated effective voltage is lower than the reference voltage of one of the third halogen lamp heater and the fourth halogen lamp heater, determines whether a temperature change detected by the temperature detecting unit shows a tendency to rise or whether the temperature change shows a tendency to drop, when the temperature change shows a tendency to rise, sets the output duty at 0, and, when the temperature change shows a tendency to drop, performs the half-wave control with the output Duty equivalent to the reference voltage of one of the third halogen lamp heater and the fourth halogen lamp heater.

To achieve the abovementioned object, according to an aspect, an image forming apparatus reflecting one aspect of the present invention comprises the fixing device of any one of Items. 1 to 6.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of a fixing device and an image forming apparatus of the present invention will be described with reference to the drawings. However, the scope of the invention is not limited to the illustrated examples.

Figure 1:
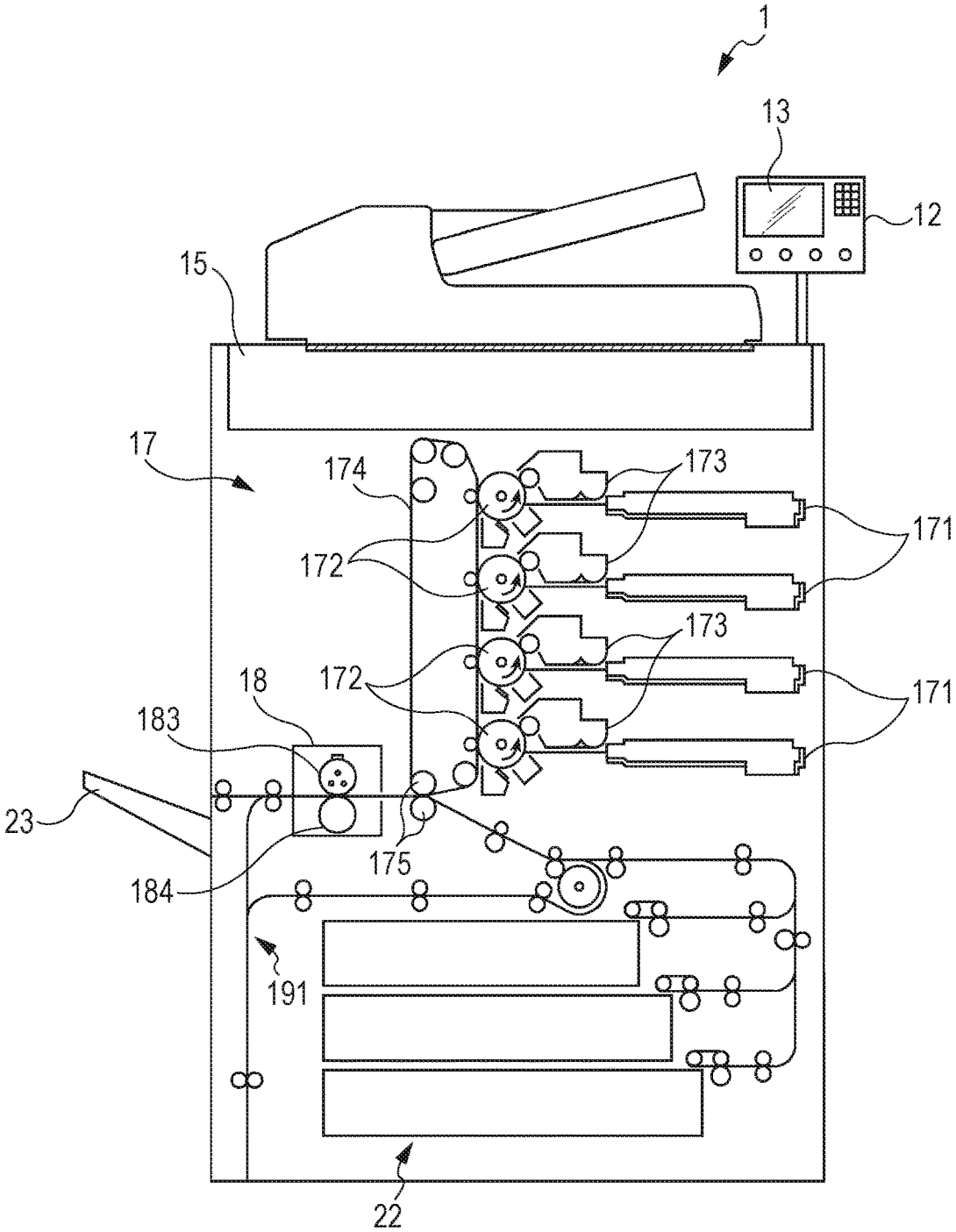
FIG. 1 is a diagram schematically showing the configuration of an image forming system.
Figure 2:
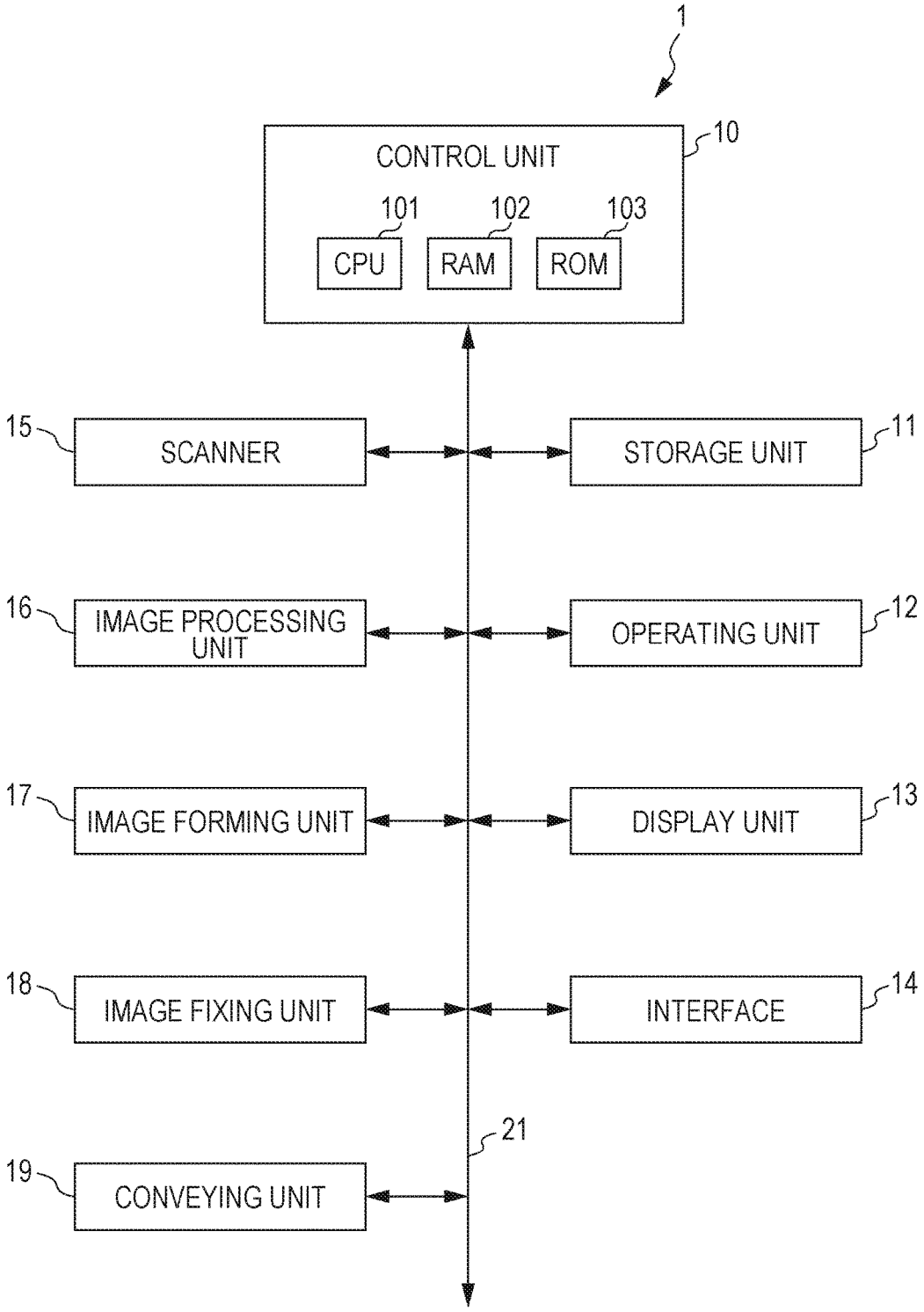
FIG. 2 is a block diagram showing the principal functional configuration of an image forming apparatus.

FIG. 1 is a diagram schematically showing the configuration of an image forming apparatus 1 that is an embodiment of the present invention. FIG. 2 is a block diagram showing the principal functional configuration of the image forming apparatus 1.

The image forming apparatus 1 includes a control unit 10 that includes a central processing unit (CPU) 101, a random access memory (RAM) 102, and a read only memory (ROM) 103, a storage unit 11, an operating unit 12, a display unit 13, an interface 14, a scanner 15, an image processing unit 16, an image forming unit 17, an image fixing unit 18, and a conveying unit 19. Via a bus 21, the control unit 10 is connected to the storage unit 11, the operating unit 12, the display unit 13, the interface 14, the scanner 15, the image processing unit 16, the image forming unit 17, the image fixing unit 18, and the conveying unit 19.

The CPU 101 reads and executes control programs stored in the ROM 103 or the storage unit 11, and performs various calculation processes.

The RAM 102 provides a work memory space for the CPU 101, and temporarily stores data.

The ROM 103 stores various control programs to be executed by the CPU 101, setting data, and the like. Instead of the ROM 103, a rewritable nonvolatile memory, such as an electrically erasable programmable read only memory (EEPROM) or a flash memory, may be used.

The control unit 10 including the CPU 101, the RAM 102, and the ROM 103 collectively controls the respective components of the image forming apparatus 1 in accordance with the above various control programs. For example, the control unit 10 causes the image processing unit 16 to perform predetermined image processing on image data and store the image data into the storage unit 11. The control unit 10 also causes the conveying unit 19 to convey a paper sheet, and causes the image forming unit 17 to form an image on the paper sheet in accordance with the image data stored in the storage unit 11.

The storage unit 11 is formed with a dynamic random access memory (DRAM) or the like, and stores image data obtained with the scanner 15, image data input from the outside via the interface 14, and the like. Such image data and the like may be stored in the RAM 102.

The operating unit 12 includes input devices, such as operation keys and a touch panel placed on the screen of the display unit 13. The operating unit 12 converts an operation that is input through these input devices into an operation signal, and outputs the operation signal to the control unit 10.

The display unit 13 includes a display device, such as a liquid crystal display (LCD), and displays an operation screen or the like that shows the state of the image forming apparatus 1 or the contents of the operation input through the touch panel.

The interface 14 is a means to perform data transmission/reception with an external computer, another image forming apparatus, or the like, and is formed with a serial interface of one of various kinds, for example.

The scanner 15 reads an image formed on a paper sheet, generates image data including single-color data of each of the color components R (red), G (green), and B (blue), and stores the image data into the storage unit 11.

The image processing unit 16 includes a rasterizing unit, a color converting unit, a tone correcting unit, and a halftone processing unit, for example. The image processing unit 16 performs various kinds of image processing on the image data stored in the storage unit 11, and stores the processed image data into the storage unit 11.

The image forming unit 17 forms an image on a paper sheet in accordance with the image data stored in the storage unit 11. The image forming unit 17 includes four sets of an exposing unit 171, a photosensitive member 172, and a developing unit 173. These four sets correspond to the respective color components C (cyan), M (magenta), Y (yellow), and K (black). The image forming unit 17 also includes a transfer member 174 and secondary transfer rollers 175.

Each exposing unit 171 includes a laser diode (LD) as a light emitting element. The exposing unit 171 drives the LD in accordance with the image data, irradiates and exposes the charged photosensitive member 172 with laser light, and forms an electrostatic latent image on the photosensitive member 172. The developing unit 173 supplies toner (color material) of a predetermined color (one of C, M, Y, and K) onto the charged photosensitive member 172 with a charged developing roller, and develops the electrostatic latent image formed on the photosensitive member 172.

Images (single-color images) formed with toner of C, M, Y, and K on the four photosensitive members 172 corresponding to C, M, Y, and K, respectively, are transferred onto the transfer member 174 one by one from the respective photosensitive members 172 in a superimposing manner. As a result, a color image having C, M, Y, and K as the color components is formed on the transfer member 174. The transfer member 174 is an endless belt wound around transfer member conveying rollers, and rotates with the respective transfer member conveying rollers.

The secondary transfer rollers 175 transfer the color image on the transfer member 174 onto a paper sheet supplied from a paper feed tray 22 or a sheet feeder provided outside. Specifically, when a predetermined transfer voltage is applied to the secondary transfer rollers 175 having a paper sheet and the transfer member 174 nipped in between, the toner forming the color image on the transfer member 174 is drawn toward the paper sheet, and thus, is transferred to the paper sheet.

The image fixing unit 18 performs a fixing process of fixing the toner to the paper sheet by heating and pressing the paper sheet having the toner transferred thereto.

Figure 3:
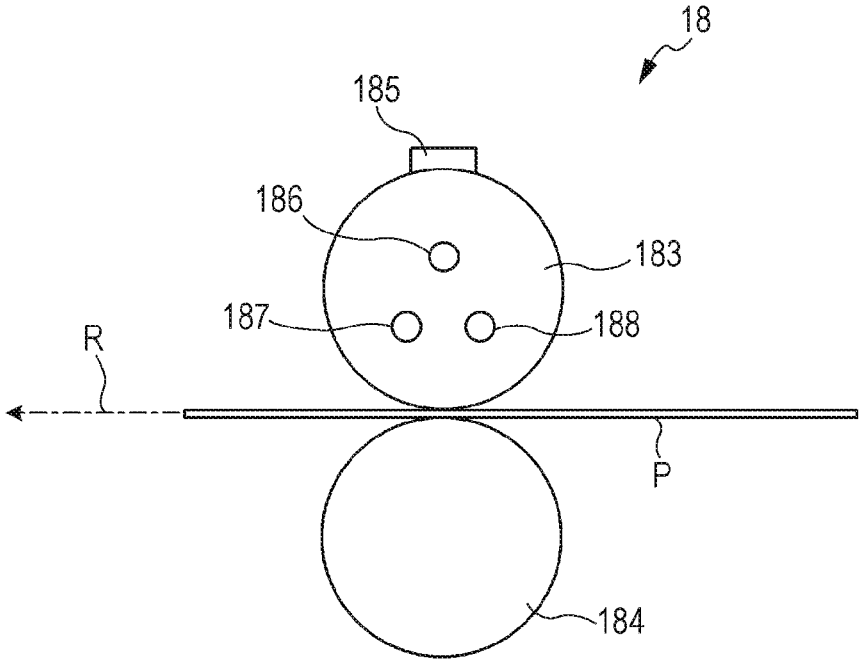
FIG. 3 is a schematic diagram showing the structure of an image fixing unit.

FIG. 3 is a schematic diagram showing the structure of the image fixing unit 18. The image fixing unit 18 includes a fixing roller (the fixing member) 183, a pressure roller (the pressure member) 184, and a temperature detecting unit 185. The image fixing unit 18 and the control unit 10 constitute a fixing device.

The fixing roller 183 includes halogen lamp heaters 186 through 188 extending in the rotational axis thereof. The halogen lamp heaters 186 through 188 generate heat when energized under the control of the control unit 10. The fixing roller 183 is driven by a rotary drive means (not shown), such as a motor, under the control of the control unit 10. The temperature detecting unit 185 that detects the temperature of the fixing roller 183 is also attached to the fixing roller 183. Only one temperature detecting unit 185 may be provided, or more than one temperature detecting unit 185 may be provided, as long as the temperature of the fixing roller 183 can be detected.

Figure 4:
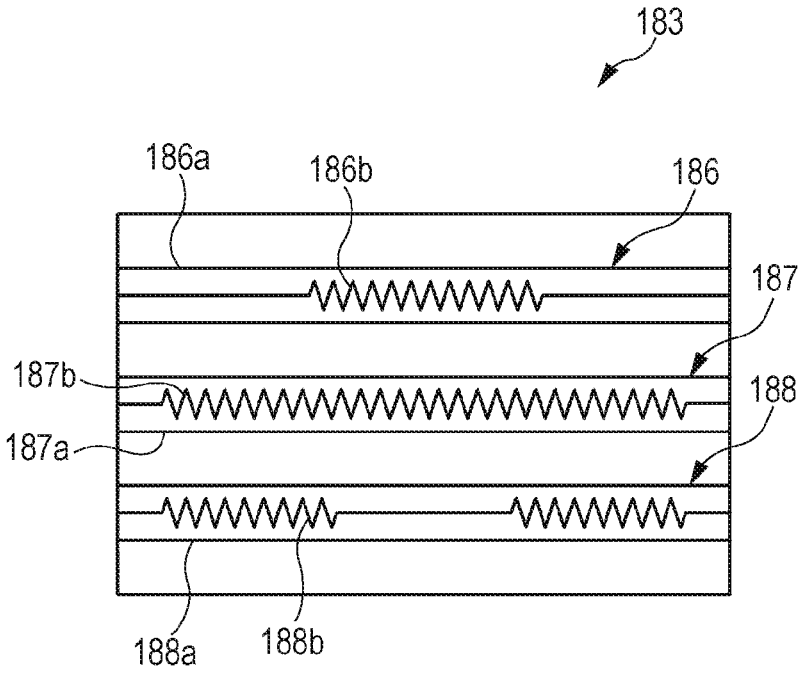
FIG. 4 is a schematic diagram showing the internal structure of a fixing roller.

FIG. 4 is a schematic diagram showing the internal structure of the fixing roller 183.

The halogen lamp heaters 186 through 188 are formed with tungsten filaments **186*b* through 188*b* in cylindrical portions 186*a* through 188*a*, and halogen gases of predetermined densities are contained in the respective cylindrical portions 186*a* through 188*a*. In accordance with the densities of the halogen gases contained in the cylindrical portions 186*a* through 188*a*, reference voltages of the respective halogen lamp heaters 186 through 188 are set. A reference voltage in the present invention is a voltage to be applied to a halogen lamp heater so that a halogen cycle can be performed in the smoothest manner without any chemical attack or the like. A reference voltage has a value that is set for each halogen lamp heater in accordance with the density of the contained halogen gas. Therefore, when a lower voltage than the reference voltage of a halogen lamp heater is applied, a halogen cycle might not be smoothly performed, and a chemical attack might occur. The halogen lamp heaters 186 through 188** have the same rated voltage, and differ only in reference voltage.

The filament 186*b* of the halogen lamp heater 186 is designed to heat only the central portion of the fixing roller 183 in its axial direction, the filament 187*b* of the halogen lamp heater 187 is designed to heat the entire portion of the fixing roller 183 in its axial direction, and the filament 188*b* of the halogen lamp heater 188 is designed to heat only the end portions of the fixing roller 183 in its axial direction.

As shown in FIG. 3, the pressure roller 184 is pushed toward the fixing roller 183 by an elastic member (not shown), and is pressed against the fixing roller 183. Forming a fixing nip between the pressure roller 184 and the fixing roller 183, the pressure roller 184 rotates with the fixing roller 183.

The pressure roller 184 may rotate when being driven by a rotary drive means (not shown), such as a motor, under the control of the control unit 10.

The fixing roller 183 and the pressure roller 184 heat and press a paper sheet P while nipping the paper sheet P with the fixing nip and conveying the paper sheet P in a conveyance direction R indicated by an arrow in FIG. 3. By doing so, the fixing roller 183 and the pressure roller 184 melt and fix the toner on the paper sheet P. When in contact with the paper sheet P, the temperature of the fixing roller 183 is in the range of 180 to 200 degrees centigrade, for example. Therefore, the halogen lamp heaters 186 through 188 heat the fixing roller 183 so that the temperature of the fixing roller 183 becomes a temperature within this range.

As shown in FIG. 1, the conveying unit 19 includes sheet conveying rollers that convey a paper sheet by rotating while nipping the paper sheet. The conveying unit 19 conveys the paper sheet through a predetermined conveyance path. The conveying unit 19 includes a reversing mechanism 191 that reverses a paper sheet on which a fixing process has been performed by the image fixing unit 18, and then conveys the paper sheet to the secondary transfer rollers 175. In the image forming apparatus 1, in a case where images are to be formed on both surfaces of a paper sheet, the paper sheet is reversed by the reversing mechanism 191. After the images are formed on both surfaces, the paper sheet is discharged onto a paper receiving tray 23. In a case where an image is to be formed on one surface of a paper sheet, the paper sheet is not reversed by the reversing mechanism 191. After the image is formed on the one surface, the paper sheet is discharged onto the paper receiving tray 23.

Next, operations of the halogen lamp heaters 186 through 188 and a method of controlling the halogen lamp heaters 186 through 188 in the image forming apparatus 1 are described.

In this embodiment, the control unit 10 performs half-wave control on the halogen lamp heater 186 by calculating an output Duty in accordance with a temperature detected by the temperature detecting unit 185 and performing energization or de-energization for each half-wave of an AC waveform in accordance with the output Duty, and performs switch on/off control on the halogen lamp heaters 187 and 188. That is, the halogen lamp heater 186 serves as a first halogen lamp heater, and the halogen lamp heaters 187 and 188 serve as second halogen lamp heaters.

The control unit 10 controls the voltage to be applied to the halogen lamp heater 186 by performing half-wave control to control energization for each half-wave of the voltage waveform of an AC power supply (not shown). Here, a half-wave means a waveform that has a length equivalent to half a cycle of the voltage waveform of the AC power supply, and is segmented at 0 degrees in phase and at 180 degrees in phase.

As described above, reference voltages are set in the halogen lamp heaters 186 through 188 in accordance with the densities of the contained halogen gases. If an effective voltage becomes lower than the corresponding reference voltage, a chemical attack occurs. Therefore, in a conventional halogen lamp heater, the density of the halogen gas is set so that the reference voltage has the same value as the rated voltage. In the halogen lamp heaters 187 and 188 on which the control unit 10 performs switch on/off control, the reference voltage is set at the same value as the rated voltage. In the halogen lamp heater 186 on which the control unit 10 performs half-wave control, on the other hand, the density of the halogen gas is set at a low value so that the reference voltage is set at a lower value than the rated voltage. That is, the reference voltage of the halogen lamp heater 186 is set at a lower value than the reference voltage of the halogen lamp heaters 187 and 188. As the halogen lamp heater 186 is designed in this manner, half-wave control is performed so that the effective voltage can be prevented from becoming lower than the reference voltage even if the effective voltage becomes lower than the rated voltage. Thus, chemical attacks can be prevented.

Table 1 shows an example of the reference voltages of the halogen lamp heaters 186 through 188 and the densities of the halogen gases.

TABLE 1

| Halogen lamp heater | Type | Control method | Rated voltage [V] | Reference voltage [V] | Halogen gas density [mass %] |
|---|---|---|---|---|---|
| Halogen lamp heater 186 | Central light distribution | Half-wave contral | 200 | 80-100 | 40-50 |
| Halogen lamp heater 187 | Total light distribution | On/off control | 200 | 200 | 100 |
| Halogen lamp heater 188 | End light distribution | On/off control | 200 | 200 | 100 |

As shown in Table 1, in a case where the effective voltage calculated from the range of the output Duty to be output to heat the fixing roller 183 to a desired fixing temperature is 80 to 200 V, and the effective voltage with the highest usage frequency is 100 V in the halogen lamp heater 186 on which the half-wave control is performed, a chemical attack might occur when a voltage equal to or lower than the reference voltage is applied. Therefore, the reference voltage of the halogen lamp heater 186 is set at a value of 80 to 100 V.

In a case where the reference voltage of the halogen lamp heater 186 is set at 80 V, all the range of the output Duty corresponding to the effective voltage of 80 to 200 V can be used during the temperature control. To prevent a blackening phenomenon that might occur in a case where a voltage excessively higher than the reference voltage is applied to a halogen lamp heater, it is preferable to perform control so that a voltage excessively higher than the reference voltage will not be applied. A blackening phenomenon is a phenomenon in which the tungsten gasified from the filament is deposited on the inner surface of the cylindrical portion without binding to the halogen gas in a case where the amount of the contained halogen gas is small.

In a case where the reference voltage of the halogen lamp heater 186 is set at 100 V, the control unit 10 preferably does not output an output Duty equivalent to a voltage that is not lower than 80V but is lower than 100 V. Not outputting an output Duty equivalent to a voltage that is not lower than 80 V but is lower than 100 V, the control unit 10 outputs an output Duty equivalent to a voltage of 100 V, which is the reference voltage, or sets the output Duty at 0 or outputs an output Duty not to apply any voltage, so that the temperature of the fixing roller 183 approaches a target temperature. Which one of these outputs Duty should be output may be determined in accordance with the transition of the temperature of the fixing roller 183, for example. In this case, an output Duty not to apply any voltage is output in a case where the transition of temperature of the fixing roller 183 shows a tendency to rise, and an output Duty equivalent to a voltage of 100 V is output in a case where the temperature transition shows a tendency to drop.

That is, the control unit 10 calculates the output Duty from the temperature of the fixing roller 183 detected by the temperature detecting unit 185 and a predetermined target temperature. The control unit 10 then calculates an effective voltage from the calculated output Duty and the rated voltage of the halogen lamp heater 186. In a case where the calculated effective voltage is higher than the reference voltage of the halogen lamp heater 186, the control unit 10 performs half-wave control with the calculated output Duty. In a case where the calculated effective voltage is lower than the reference voltage of the halogen lamp heater 186, the control unit 10 determines whether a temperature change detected by the temperature detecting unit 185 shows a tendency to rise or whether the temperature change shows a tendency to drop. In a case where the temperature change shows a tendency to rise, the control unit 10 sets the output duty at 0. In a case where the temperature change shows a tendency to drop, the control unit 10 performs half-wave control with the output Duty equivalent to the reference voltage of the halogen lamp heater 186.

Figure 5:
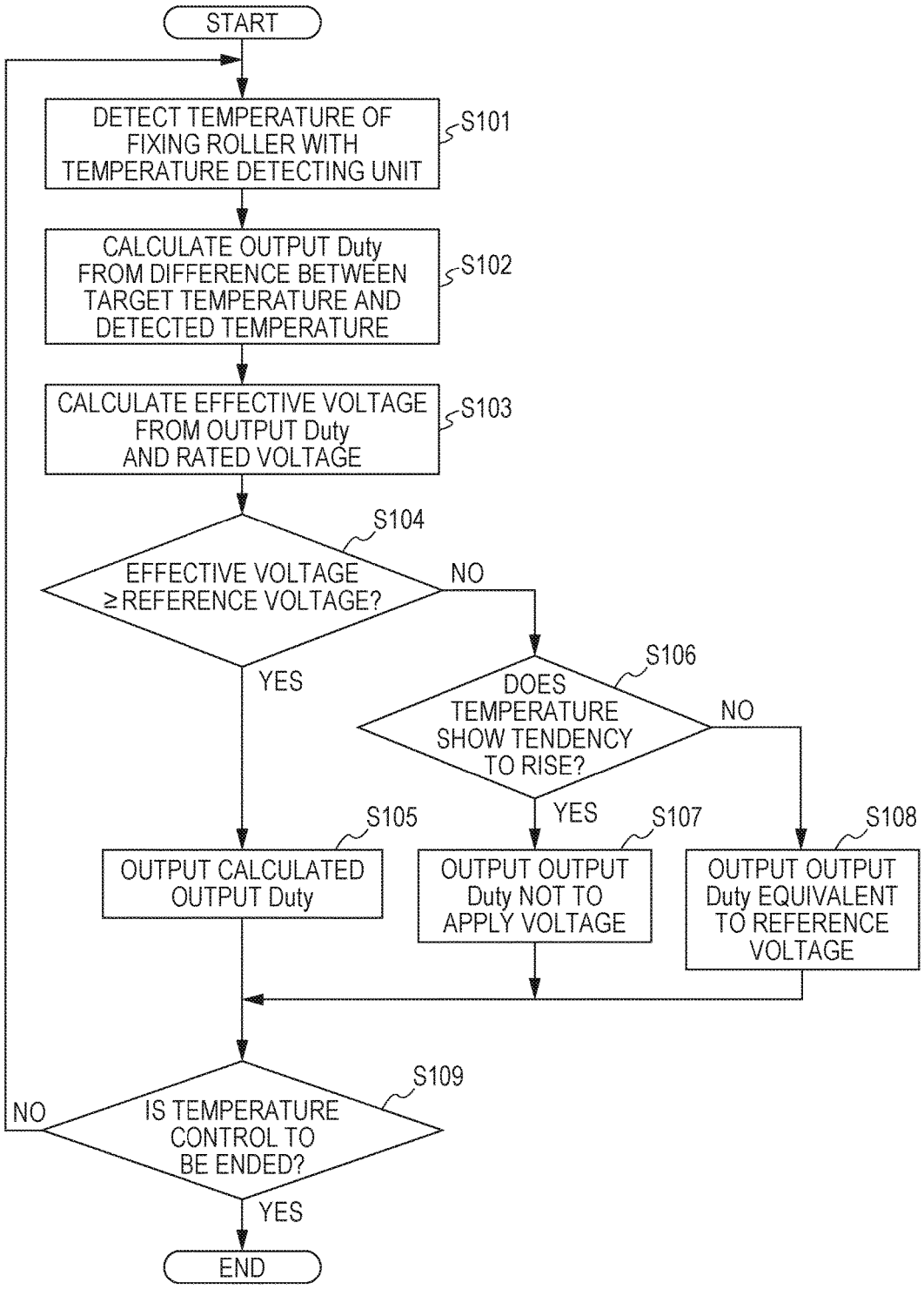
FIG. 5 is a flowchart showing an example of a temperature control process.

Referring now to FIG. 5, an example of a temperature control process to be performed on the halogen lamp heater 186 by the control unit 10 is described in detail.

FIG. 5 is a flowchart showing the example of a temperature control process to be performed on the halogen lamp heater 186. The control unit 10 performs the conventional switch on/off control on the halogen lamp heaters 187 and 188, and therefore, explanation thereof is not made herein.

First, the control unit 10 detects the temperature of the fixing roller 183 with the temperature detecting unit 185 (step S101). It should be noted that the control unit 10 detects the temperature of the fixing roller 183 with the temperature detecting unit 185 in real time, and continues the temperature detection in the respective procedures after step S101.

Next, the control unit 10 calculates an output Duty from a predetermined target temperature and the temperature detected through the procedure in step S101 (step S102).

The control unit 10 then calculates an effective voltage from the output Duty calculated in step S102 and the rated voltage of the halogen lamp heater 186 (step S103).

Next, the control unit 10 determines whether the effective voltage calculated in step S103 is equal to or higher than the reference voltage of the halogen lamp heater 186 (step S104). The reference voltage of the halogen lamp heater 186 has been set beforehand at the time of the manufacturing of the halogen lamp heaters, and is stored in the storage unit 11, the RAM 102, or the like.

If the effective voltage is determined to be equal to or higher than the reference voltage of the halogen lamp heater 186 (YES in step S104), the control unit 10 outputs the output Duty calculated in step S102 (step S105). For example, in a case where the reference voltage of the halogen lamp heater 186 is 80 V, and the calculated effective voltage is 100 V, it is safe to assume that no chemical attacks will occur. Therefore, the control unit 10 outputs the calculated output Duty, to apply a voltage of 100 V to the halogen lamp heater 186.

If the effective voltage is determined to be lower than the reference voltage of the halogen lamp heater 186 (NO in step S104), on the other hand, the control unit 10 determines whether the temperature of the fixing roller 183 shows a tendency to rise (step S106). Specifically, in accordance with the transition of the temperature of the fixing roller 183 being detected by the temperature detecting unit 185 in real time, the control unit 10 determines whether the temperature of the fixing roller 183 shows a tendency to rise or whether the temperature of the fixing roller 183 shows a tendency to drop.

If the temperature of the fixing roller 183 is determined to show a tendency to rise (YES in step S106), the control unit 10 sets the output Duty at 0, or outputs such an output Duty as not to apply any voltage to the halogen lamp heater 186 (step S107). Consequently, even if the effective voltage is lower than the reference voltage, the halogen lamp heater 186 is put into an off-state, and chemical attacks can be prevented.

If the temperature of the fixing roller 183 is determined to show a tendency to drop (NO in step S106), the control unit 10 outputs the output Duty equivalent to the reference voltage (step S108). Consequently, even if the effective voltage is lower than the reference voltage, a voltage equivalent to the reference voltage can be applied to the halogen lamp heater 186. Thus, chemical attacks can be prevented.

Next, the control unit 10 determines whether to end the temperature control (step S109). Specifically, in a case where an image forming process by the image forming unit 17 has ended, the control unit 10 determines to end the temperature control. In a case where the image forming process has not ended, the control unit 10 determines not to end the temperature control. If the control unit 10 determines not to end the temperature control (NO in step S109), the control unit 10 repeats the procedures in steps S101 through S108. If the control unit 10 determines to end the temperature control (YES in step S109), the control unit 10 ends the temperature control process for the halogen lamp heater 186.

According to the above described embodiment, a fixing device that includes the fixing roller 183, the pressure roller 184 pressed against the fixing roller 183, and the halogen lamp heaters 186 through 188 that heat the fixing roller 183 further includes: the temperature detecting unit 185 that detects the temperature of the fixing roller 183; and the control unit 10 that performs half-wave control on the halogen lamp heater 186 by calculating an output Duty in accordance with the temperature detected by the temperature detecting unit 185 and performing energization or de-energization for each half-wave of an AC waveform in accordance with the output Duty, and performs switch on/off control on the halogen lamp heaters 187 and 188. The halogen lamp heaters 186 through 188 have reference voltages that are set in accordance with the densities of the contained halogen gases, and the reference voltages satisfy "the reference voltage of the halogen lamp heater 186<the reference voltage of the halogen lamp heaters 187 and 188". In view of this, the reference voltage of the halogen lamp heater 186 on which the half-wave control is performed is set at a low value, so that the effective voltage can be prevented from becoming lower than the reference voltage. Thus, chemical attacks can be appropriately prevented in a case where half-wave control is performed on a halogen lamp heater.

Furthermore, the control unit 10 calculates the output Duty from the temperature of the fixing roller 183 detected by the temperature detecting unit 185 and the predetermined target temperature. The control unit 10 then calculates an effective voltage from the calculated output Duty and the rated voltage of the halogen lamp heater 186. In a case where the calculated effective voltage is higher than the reference voltage of the halogen lamp heater 186, the control unit 10 performs half-wave control with the calculated output Duty. In a case where the calculated effective voltage is lower than the reference voltage of the halogen lamp heater 186, the control unit 10 determines whether a temperature change detected by the temperature detecting unit 185 shows a tendency to rise or whether the temperature change shows a tendency to drop. In a case where the temperature change shows a tendency to rise, the control unit 10 sets the output duty at 0. In a case where the temperature change shows a tendency to drop, the control unit 10 performs half-wave control with the output Duty equivalent to the reference voltage of the halogen lamp heater 186. Thus, chemical attacks can be prevented, even if the effective voltage becomes lower than the reference voltage in the halogen lamp heater 186.

In the above described embodiment, the fixing device includes one halogen lamp heater (the halogen lamp heater 186) that serves as a first halogen lamp heater, and two halogen lamp heaters (the halogen lamp heaters 187 and 188) that serve as second halogen lamp heaters. However, the present invention is not limited to this configuration. For example, a fixing device may include two or more halogen lamp heaters that serve as first halogen lamp heaters, or may include one halogen lamp heater or three or more halogen lamp heaters that serve as second halogen lamp heaters.

[First Modification]

A first modification of the image forming apparatus 1 of the above described embodiment is now described.

The image forming apparatus 1 of the first modification has substantially the same configuration as the image forming apparatus 1 of the above described embodiment, but differs in the aspects described below. Specifically, in the image forming apparatus 1 of the first modification, the control unit 10 performs the above described half-wave control on the halogen lamp heaters 186 and 188, and performs the switch on/off control on the halogen lamp heater 187.

In first modification, the control unit 10 performs half-wave control on the halogen lamp heater 188 that heats the end portions of the fixing roller 183 in its axial direction and on the halogen lamp heater 186 that heats the central portion of the fixing roller 183 in its axial direction by calculating an output Duty in accordance with a temperature detected by the temperature detecting unit 185 and performing energization or de-energization for each half-wave of an AC waveform in accordance with the output Duty. That is, in the first modification, the halogen lamp heater 186 serves as a central-portion halogen lamp heater, and the halogen lamp heater 188 serves as an end-portion halogen lamp heater. In the first modification, the control unit 10 performs switch on/off control on the halogen lamp heater 187.

In the halogen lamp heater 187 on which the control unit 10 performs switch on/off control, the reference voltage and the rated voltage are set at the same value. In the halogen lamp heaters 186 and 188 on which the control unit 10 performs half-wave control, on the other hand, the density of the halogen gas is set at a low value so that the reference voltage is set at a lower value than the rated voltage. As the halogen lamp heaters 186 and 188 are designed in this manner, half-wave control is performed so that the effective voltage can be prevented from becoming lower than the reference voltage even if the effective voltage becomes lower than the rated voltage. Thus, chemical attacks can be prevented.

The halogen lamp heater 188 that heats the end portions of the fixing roller 183 in its axial direction and the halogen lamp heater 186 that heats the central portion of the fixing roller 183 in its axial direction need to be heated to similar temperatures before a start of image formation. However, the amount of heat for the halogen lamp heater 188 is smaller than that for the halogen lamp heater 186, though it depends on the type and the size of the paper during image formation. In a case where half-wave control is performed on both halogen lamp heaters 186 and 188, the output Duty required by the halogen lamp heater 188 is the smaller. Therefore, if the halogen lamp heaters 186 and 188 are designed to have the same reference voltage, a chemical attack might occur in the halogen lamp heater 188. In view of this, in the halogen lamp heaters 186 and 188 of the first modification, the reference voltage of the halogen lamp heater 188 is set at a lower value than the reference voltage of the halogen lamp heater 186, so that the effective voltage can be certainly prevented from becoming lower than the reference voltage in the halogen lamp heater 188, and chemical attacks can be effectively prevented. For example, the reference voltages of the halogen lamp heaters 186 through 188 of the first modification and the densities of the halogen gases are set as shown in Table 2.

TABLE 2

| Halogen lamp heater | Type | Control mehod | Rated voltage [V] | Reference voltage [V] | Halogen gas density [mass %] |
|---|---|---|---|---|---|
| Halogen lamp heater 186 | Central light distribution | Half-wave control | 200 | 100 | 50 |
| Halogen lamp heater 187 | Total light distribution | On/off control | 200 | 200 | 100 |
| Halogen lamp heater 188 | End light distribution | Half-wave control | 200 | 80 | 40 |

Furthermore, the control unit 10 of the first modification calculates the output Duty from the temperature of the fixing roller 183 detected by the temperature detecting unit 185 and a predetermined target temperature. The control unit 10 then calculates an effective voltage from the calculated output Duty and the rated voltage of the halogen lamp heater 188 or the halogen lamp heater 186. In a case where the calculated effective voltage is higher than the reference voltage of the halogen lamp heater 188 or the halogen lamp heater 186, the control unit 10 performs half-wave control with the calculated output Duty. In a case where the calculated effective voltage is lower than the reference voltage of the halogen lamp heater 188 or the halogen lamp heater 186, the control unit 10 determines whether a temperature change detected by the temperature detecting unit 185 shows a tendency to rise or whether the temperature change shows a tendency to drop. In a case where the temperature change shows a tendency to rise, the control unit 10 sets the output duty at 0. In a case where the temperature change shows a tendency to drop, the control unit 10 performs half-wave control with the output Duty equivalent to the reference voltage of the halogen lamp heater 188 or the halogen lamp heater 186. Specifically, the control unit 10 performs the temperature control process shown in FIG. 5, for example, on each of the halogen lamp heaters 186 and 188, as in the above described embodiment.

According to the above described first modification, a fixing device that includes the fixing roller 183, the pressure roller 184 pressed against the fixing roller 183, and the halogen lamp heaters 186 through 188 that heat the fixing roller 183 further includes: the temperature detecting unit 185 that detects the temperature of the fixing roller 183; and the control unit 10 that performs half-wave control on the halogen lamp heater 188 that heats the end portions of the fixing roller 183 in its axial direction and on the halogen lamp heater 186 that heats the central portion of the fixing roller 183 in its axial direction, by calculating an output Duty in accordance with the temperature detected by the temperature detecting unit 185 and performing energization or de-energization for each half-wave of an AC waveform in accordance with the output Duty. The halogen lamp heater 188 and the halogen lamp heater 186 have reference voltages that are set in accordance with the densities of the contained halogen gases, and the reference voltages are lower than the rated voltage and satisfy "the reference voltage of the halogen lamp heater 188<the reference voltage of the halogen lamp heater 186". In view of this, the reference voltages of the halogen lamp heaters 186 and 188 on which the half-wave control is performed are set at low values, so that the effective voltage can be prevented from becoming lower than the corresponding reference voltage. Thus, chemical attacks can be appropriately prevented in a case where half-wave control is performed on halogen lamp heaters. Furthermore, the halogen lamp heater 188 has a higher frequency of usage of a low output Duty than the halogen lamp heater 186. In view of this, the reference voltage of the halogen lamp heater 188 is set at a lower value than the reference voltage of the halogen lamp heater 186, so that the effective voltage can be certainly prevented from becoming lower than the reference voltage in the halogen lamp heater 188, and chemical attacks can be effectively prevented.

Furthermore, the control unit 10 calculates the output Duty from the temperature of the fixing roller 183 detected by the temperature detecting unit 185 and the predetermined target temperature. The control unit 10 then calculates an effective voltage from the calculated output Duty and the rated voltage of the halogen lamp heater 188 or the halogen lamp heater 186. In a case where the calculated effective voltage is higher than the reference voltage of the halogen lamp heater 188 or the halogen lamp heater 186, the control unit 10 performs half-wave control with the calculated output Duty. In a case where the calculated effective voltage is lower than the reference voltage of the halogen lamp heater 188 or the halogen lamp heater 186, the control unit 10 determines whether a temperature change detected by the temperature detecting unit 185 shows a tendency to rise or whether the temperature change shows a tendency to drop. In a case where the temperature change shows a tendency to rise, the control unit 10 sets the output duty at 0. In a case where the temperature change shows a tendency to drop, the control unit 10 performs half-wave control with the output Duty equivalent to the reference voltage of the halogen lamp heater 188 or the halogen lamp heater 186. Thus, chemical attacks can be prevented, even if the effective voltage becomes lower than the reference voltages in the halogen lamp heaters 186 and 188.

In the first modification, the fixing device includes the halogen lamp heater 187 on which the control unit 10 performs switch on/off control. However, the fixing device may not include the halogen lamp heater 187. That is, the fixing device of the first modification may include only the halogen lamp heaters on which the control unit 10 performs half-wave control.

Furthermore, in the first modification, the fixing device includes one halogen lamp heater (the halogen lamp heater 186) that serves as a central-portion halogen lamp heater, and one halogen lamp heater (the halogen lamp heater 188) that serves as an end-portion halogen lamp heater. However, the present invention is not limited to this configuration. For example, a fixing device may include two or more halogen lamp heaters that serve as central-portion halogen lamp heaters, or may include two or more halogen lamp heaters that serve as end-portion halogen lamp heaters.

[Second Modification]

A second modification of the image forming apparatus 1 of the above described embodiment is now described.

The image forming apparatus 1 of the second modification has substantially the same configuration as the image forming apparatus 1 of the above described embodiment, but differs in the aspects described below. Specifically, in the image forming apparatus 1 of the second modification, the control unit 10 performs the above described half-wave control on the halogen lamp heaters 186 and 187, and performs the switch on/off control on the halogen lamp heater 188.

In the second modification, the control unit 10 performs half-wave control on the halogen lamp heater 186 and the halogen lamp heater 187 that heat overlapping portions of the fixing roller 183 in its axial direction by calculating an output Duty in accordance with a temperature detected by the temperature detecting unit 185 and performing energization or de-energization for each half-wave of an AC waveform in accordance with the output Duty. That is, in the second modification, the halogen lamp heater 186 serves as a third halogen lamp heater, and the halogen lamp heater 187 serves as a fourth halogen lamp heater. In the second modification, the control unit 10 performs switch on/off control on the halogen lamp heater 188.

In the halogen lamp heater 188 on which the control unit 10 performs switch on/off control, the reference voltage and the rated voltage are set at the same value. In the halogen lamp heaters 186 and 187 on which the control unit 10 performs half-wave control, on the other hand, the density of the halogen gas is set at a low value so that the reference voltage is set at a lower value than the rated voltage. As the halogen lamp heaters 186 and 187 are designed in this manner, half-wave control is performed so that the effective voltage can be prevented from becoming lower than the reference voltage even if the effective voltage becomes lower than the rated voltage. Thus, chemical attacks can be prevented.

The halogen lamp heaters 186 and 187 that have overlapping regions to heat in the fixing roller 183 in its axial direction require different amounts of heat, and therefore, have different outputs Duty to be most frequently output. In a case where half-wave control is performed on both halogen lamp heaters 186 and 187, if the halogen lamp heaters 186 and 187 are designed to have the same reference voltage, a chemical attack might occur in the halogen lamp heater 186. In view of this, the halogen lamp heaters 186 and 187 of the second modification are designed so that the reference voltage of the halogen lamp heater 186 having the smaller output Duty to be most frequently output is lower than the reference voltage of the halogen lamp heater 187. With this, the effective voltage can be more certainly prevented from becoming lower than the reference voltage in the halogen lamp heater 186, and chemical attacks can be effectively prevented. For example, the reference voltages of the halogen lamp heaters 186 through 188 of the second modification and the densities of the halogen gases are set as shown in Table 3.

The set temperature (the fixing temperature) of the fixing roller 183 is set at 180 to 200 degrees centigrade for each image forming apparatus, and does not greatly vary with image forming conditions or paper types. Therefore, the "outputs Duty to be most frequency output" with respect to the respective halogen lamp heaters are set beforehand for the respective halogen lamp heaters at the time of manufacturing of the respective halogen lamp heaters.

TABLE 3

| Halogen lamp heater | Type | Control method | Rated voltage [V] | Reference voltage [V] | Halogen gas density [mass %] |
|---|---|---|---|---|---|
| Halogen lamp heater 186 | Central light distribution | Half-wave control | 200 | 80 | 40 |
| Halogen lamp heater 187 | Total light distribution | Half-wave control | 200 | 120 | 60 |
| Halogen lamp heater 188 | End light distribution | On/off control | 200 | 200 | 100 |

Furthermore, the control unit 10 of the second modification calculates the output Duty from the temperature of the fixing roller 183 detected by the temperature detecting unit 185 and a predetermined target temperature. The control unit 10 then calculates an effective voltage from the calculated output Duty and the rated voltage of the halogen lamp heater 186 or the halogen lamp heater 187. In a case where the calculated effective voltage is higher than the reference voltage of the halogen lamp heater 186 or the halogen lamp heater 187, the control unit 10 performs half-wave control with the calculated output Duty. In a case where the calculated effective voltage is lower than the reference voltage of the halogen lamp heater 186 or the halogen lamp heater 187, the control unit 10 determines whether a temperature change detected by the temperature detecting unit 185 shows a tendency to rise or whether the temperature change shows a tendency to drop. In a case where the temperature change shows a tendency to rise, the control unit 10 sets the output duty at 0. In a case where the temperature change shows a tendency to drop, the control unit 10 performs half-wave control with the output Duty equivalent to the reference voltage of the halogen lamp heater 186 or the halogen lamp heater 187. Specifically, the control unit 10 performs the temperature control process shown in FIG. 5, for example, on each of the halogen lamp heaters 186 and 187, as in the above described embodiment.

According to the above described second modification, a fixing device that includes the fixing roller 183, the pressure roller 184 pressed against the fixing roller 183, and the halogen lamp heaters 186 through 188 that heat the fixing roller 183 further includes: the temperature detecting unit 185 that detects the temperature of the fixing roller 183; and the control unit 10 that performs half-wave control on the halogen lamp heaters 186 and 187 that have overlapping regions to heat in the fixing roller 183 in its axial direction, by calculating an output Duty in accordance with the temperature detected by the temperature detecting unit 185 and performing energization or de-energization for each half-wave of an AC waveform in accordance with the output Duty. In a case where the output Duty that is most frequently output with respect to the halogen lamp heater 186 is smaller than the output Duty that is most frequently output with respect to the halogen lamp heater 187, the reference voltages that are set in accordance with the densities of the halogen gases contained in the halogen lamp heaters 186 and 187 are lower than the rated voltage and satisfy "the reference voltage of the halogen lamp heater 186<the reference voltage of the halogen lamp heater 187". In view of this, the reference voltages of the halogen lamp heaters 186 and 187 on which the half-wave control is performed are set at low values, so that the effective voltage can be prevented from becoming lower than the corresponding reference voltage. Thus, chemical attacks can be appropriately prevented in a case where half-wave control is performed on a halogen lamp heater. Furthermore, in a case where the output Duty that is most frequently output with respect to the halogen lamp heater 186 is smaller than the output Duty that is most frequently output with respect to the halogen lamp heater 187, the reference voltage of the halogen lamp heater 186 is set at a lower value than the reference voltage of the halogen lamp heater 187, so that the effective voltage can be certainly prevented from becoming lower than the reference voltage in the halogen lamp heater 186, and chemical attacks can be effectively prevented.

Furthermore, the control unit 10 calculates the output Duty from the temperature of the fixing roller 183 detected by the temperature detecting unit 185 and the predetermined target temperature. The control unit 10 then calculates an effective voltage from the calculated output Duty and the rated voltage of the halogen lamp heater 186 or the halogen lamp heater 187. In a case where the calculated effective voltage is higher than the reference voltage of the halogen lamp heater 186 or the halogen lamp heater 187, the control unit 10 performs half-wave control with the calculated output Duty. In a case where the calculated effective voltage is lower than the reference voltage of the halogen lamp heater 186 or the halogen lamp heater 187, the control unit 10 determines whether a temperature change detected by the temperature detecting unit 185 shows a tendency to rise or whether the temperature change shows a tendency to drop. In a case where the temperature change shows a tendency to rise, the control unit 10 sets the output duty at 0. In a case where the temperature change shows a tendency to drop, the control unit 10 performs half-wave control with the output Duty equivalent to the reference voltage of the halogen lamp heater 186 or the halogen lamp heater 187. Thus, chemical attacks can be prevented, even if the effective voltage becomes lower than the reference voltages in the halogen lamp heaters 186 and 187.

In the second modification, the fixing device includes the halogen lamp heater 188 on which the control unit 10 performs switch on/off control. However, the fixing device may not include the halogen lamp heater 188. That is, the fixing device of the second modification may include only the halogen lamp heaters on which the control unit 10 performs half-wave control.

Furthermore, in the second modification, the fixing device includes one halogen lamp heater (the halogen lamp heater 186) that serves as a third halogen lamp heater, and one halogen lamp heater (the halogen lamp heater 187) that serves as a fourth halogen lamp heater. However, the present invention is not limited to this configuration. For example, a fixing device may include two or more halogen lamp heaters that serve as third halogen lamp heaters, or may include two or more halogen lamp heaters that serve as fourth halogen lamp heaters.

The above described embodiment and modifications are preferred examples of the present invention, and the present invention is not limited to them. These examples can be modified as appropriate, without departing from the scope of the invention.

For example, in the above described embodiment and modifications, the fixing roller 183 includes the three halogen lamp heaters 186 through 188, but the present invention is not limited to that. The fixing roller 183 may include two halogen lamp heaters, or may include four or more halogen lamp heaters.

In the above described embodiment and modifications, the pressure roller 184 includes no halogen lamp heaters. However, the pressure roller 184 may include one of the halogen lamp heaters 186 through 188, or may include another halogen lamp heater separately from the halogen lamp heaters 186 through 188.

In the above described embodiment and modifications, the image forming apparatus 1 is a color image forming apparatus that sequentially transfers toner images from the photosensitive members onto the transfer member. However, the image forming apparatus 1 may be a tandem color image forming apparatus in which the image carriers of the respective colors are arranged in series on the intermediate transfer member, or may be a monochrome image forming apparatus that performs image formation with single-color toner.

In the above described embodiment and modifications, a paper sheet is used as a recording medium. However, not only a paper sheet such as plain paper or coated paper but also other various media such as a fabric or a sheet-like resin can be used as recording media, as long as the color material applied to the surface of each recording medium can be fixed.

In the above described embodiment and modifications, a paper sheet P is nipped between the fixing roller 183 and the pressure roller 184. However, a fixing belt may be stretched around the fixing roller 183, and a paper sheet P may be nipped between the fixing roller 183 and the pressure roller 184 via the fixing belt.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing device comprising:

a fixing member;

a pressure member pressed against the fixing member;

a plurality of halogen lamp heaters configured to heat the fixing member;

a temperature detecting unit configured to detect a temperature of the fixing member; and a control unit configured to perform half-wave control on at least one first halogen lamp heater of the halogen lamp heaters by calculating an output Duty in accordance with the temperature detected by the temperature detecting unit and performing energization or de-energization for each half-wave of an AC waveform in accordance with the output Duty, and perform switch on/off control on a second halogen lamp heater of the halogen lamp heaters, the second halogen lamp heater being other than the first halogen lamp heater, wherein the first halogen lamp heater has a reference voltage less than a reference voltage of the second halogen lamp heater, the reference voltage of the first halogen lamp heater and the reference voltage of the second halogen lamp heater being set in accordance with densities of contained halogen gases in the first and second halogen lamp heaters.

2. The fixing device according to claim 1, wherein the control unit calculates the output Duty from the temperature of the fixing member detected by the temperature detecting unit and a predetermined target temperature, calculates an effective voltage from the calculated output Duty and a rated voltage of the first halogen lamp heater, when the calculated effective voltage is higher than the reference voltage of the first halogen lamp heater, performs the half-wave control with the calculated output Duty, when the calculated effective voltage is lower than the reference voltage of the first halogen lamp heater, determines whether a temperature change detected by the temperature detecting unit shows a tendency to rise or whether the temperature change shows a tendency to drop, when the temperature change shows a tendency to rise, sets the output duty at 0, and, when the temperature change shows a tendency to drop, performs the half-wave control with the output Duty equivalent to the reference voltage of the first halogen lamp heater.

3. An image forming apparatus comprising the fixing device according to claim 1.

4. A fixing device comprising:

a fixing member;

a pressure member pressed against the fixing member;

a plurality of halogen lamp heaters configured to heat the fixing member;

a temperature detecting unit configured to detect a temperature of the fixing member; and a control unit configured to perform half-wave control on at least one end-portion halogen lamp heater and at least one central-portion halogen lamp heater of the halogen lamp heaters by calculating an output Duty in accordance with the temperature detected by the temperature detecting unit and performing energization or de-energization for each half-wave of an AC waveform in accordance with the output Duty, the end-portion halogen lamp heater being configured to heat end portions of the fixing member in an axial direction, the central-portion halogen lamp heater being configured to heat a central portion of the fixing member in the axial direction, wherein the end-portion halogen lamp heater has a reference voltage less than a reference voltage of the central-portion halogen lamp heater, the reference voltage of the end portion halogen lamp heater and the reference voltage of the central portion halogen lamp heater being set in accordance with densities of contained halogen gases in the end portion and the central portion halogen lamp heaters.

5. The fixing device according to claim 4, wherein the control unit calculates the output Duty from the temperature of the fixing member detected by the temperature detecting unit and a predetermined target temperature, calculates an effective voltage from the calculated output Duty and a rated voltage of one of the end-portion halogen lamp heater and the central-portion halogen lamp heater, when the calculated effective voltage is higher than the reference voltage of one of the end-portion halogen lamp heater and the central-portion halogen lamp heater, performs the half-wave control with the calculated output Duty, when the calculated effective voltage is lower than the reference voltage of one of the end-portion halogen lamp heater and the central-portion halogen lamp heater, determines whether a temperature change detected by the temperature detecting unit shows a tendency to rise or whether the temperature change shows a tendency to drop, when the temperature change shows a tendency to rise, sets the output duty at 0, and, when the temperature change shows a tendency to drop, performs the half-wave control with the output Duty equivalent to the reference voltage of one of the end-portion halogen lamp heater and the central-portion halogen lamp heater.

6. An image forming apparatus comprising the fixing device according to claim 4.

7. A fixing device comprising:

a fixing member;

a pressure member pressed against the fixing member;

a plurality of halogen lamp heaters configured to heat the fixing member;

a temperature detecting unit configured to detect a temperature of the fixing member; and a control unit configured to perform half-wave control on a third halogen lamp heater and a fourth halogen lamp heater of the halogen lamp heaters by calculating an output Duty in accordance with the temperature detected by the temperature detecting unit and performing energization or de-energization for each half-wave of an AC waveform in accordance with the output Duty, the third halogen lamp heater and the fourth halogen lamp heater having overlapping regions to heat in the fixing member in an axial direction, wherein, when the output Duty to be most frequently output with respect to the third halogen lamp heater is smaller than the output Duty to be most frequently output with respect to the fourth halogen lamp heater, the third halogen lamp heater having a reference voltage less than a reference voltage of the fourth halogen lamp heater, the reference voltage of the third halogen lamp heater and the reference voltage of the fourth halogen lamp heater being set in accordance with densities of contained halogen gases in the third and fourth halogen lamp heaters.

8. The fixing device according to claim 7, wherein the control unit calculates the output Duty from the temperature of the fixing member detected by the temperature detecting unit and a predetermined target temperature, calculates an effective voltage from the calculated output Duty and a rated voltage of one of the third halogen lamp heater and the fourth halogen lamp heater, when the calculated effective voltage is higher than the reference voltage of one of the third halogen lamp heater and the fourth halogen lamp heater, performs the half-wave control with the calculated output Duty, when the calculated effective voltage is lower than the reference voltage of one of the third halogen lamp heater and the fourth halogen lamp heater, determines whether a temperature change detected by the temperature detecting unit shows a tendency to rise or whether the temperature change shows a tendency to drop, when the temperature change shows a tendency to rise, sets the output duty at 0, and, when the temperature change shows a tendency to drop, performs the half-wave control with the output Duty equivalent to the reference voltage of one of the third halogen lamp heater and the fourth halogen lamp heater.

9. An image forming apparatus comprising the fixing device according to claim 7.

* * * * *